US007956881B2

(12) United States Patent
Aihara

(10) Patent No.: US 7,956,881 B2
(45) Date of Patent: Jun. 7, 2011

(54) PRINTING APPARATUS AND PRINTING METHOD

(75) Inventor: Yuichi Aihara, Kai (JP)

(73) Assignee: Nisca Corporation, Yamanashi (JP)

( * ) Notice: Subject to any disclaimer, the term of this patent is extended or adjusted under 35 U.S.C. 154(b) by 72 days.

(21) Appl. No.: 12/289,546

(22) Filed: Oct. 30, 2008

(65) Prior Publication Data

US 2009/0115832 A1 May 7, 2009

(30) Foreign Application Priority Data

Nov. 2, 2007 (JP) ..... 2007-285848

(51) Int. Cl.
*B41J 17/00* (2006.01)
*B41J 33/00* (2006.01)

(52) U.S. Cl. ..... 347/217

(58) Field of Classification Search ..... 347/217, 347/197, 215; 400/244, 223, 236, 236.2
See application file for complete search history.

(56) References Cited

U.S. PATENT DOCUMENTS

2009/0116891 A1* 5/2009 Aihara ..... 400/244

FOREIGN PATENT DOCUMENTS

JP S60-56584 A 4/1985
JP H06-45744 U 6/1994

* cited by examiner

*Primary Examiner* — Huan H Tran
(74) *Attorney, Agent, or Firm* — Manabu Kanesaka

(57) ABSTRACT

A printing apparatus includes a takeup reel driving motor which, after printing, takes up an ink ribbon to eliminate a slack in the ink ribbon. The printing apparatus includes a control device for comparing a distance (a) over which the ink ribbon R is taken up to eliminate the slack in the ink ribbon R with a distance (b) from a print end position to a print start position for a next color.

12 Claims, 19 Drawing Sheets

PRINTING APPARATUS AND PRINTING METHOD

BACKGROUND OF THE INVENTION AND RELATED ART STATEMENT

The present invention relates to a printing apparatus, and in particular, to a printing apparatus wherein a thermal head is compressed, via an ink ribbon accommodated in a cartridge, against a card, the one side of which is supported by a platen roller, to print an image on the card.

A printing apparatus is conventionally known, wherein a thermal head is compressed, via an ink ribbon, against a print sheet, the one side of which is supported by a platen roller, to print an image on the print sheet. In the printing apparatus, when the compression of the thermal head is canceled after completion of printing, the ink ribbon becomes slack to bring the ink ribbon into contact with the platen roller. In this condition, feeding or insertion of a print sheet may displace the slack ribbon from a front surface of the thermal head to prevent normal printing. Such a configuration is disclosed in Japanese Patent Application Publication No. 60-56584. Furthermore, in this condition, rotation of the platen roller may cause the ink ribbon to twine around the platen roller owing to static electricity. Such a configuration is disclosed in, for example, Japanese Utility Model Application Publication No. 06-45744.

Thus, to solve this problem, the slack ink ribbon needs to be taken up and separated from the platen roller. Both Japanese Patent Application Publication No. 60-56584 and Japanese Utility Model Application Publication No. 06-45744 disclose a technique of taking up the slack ink ribbon. Although Japanese Utility Model Application Publication No. 06-45744 prevents the slack ink ribbon from twining around a drum owing to the static electricity, the two techniques are the same in that the ink ribbon is prevented from twining around a rotating member owing to static electricity.

However, with a printing apparatus using a plurality of color ink ribbons, for example, Y (Yellow), M (Magenta), C (Cyan), Bk (Black), and Op (protect layer) may be sequentially printed in this order. In this case, a next color ink ribbon needs to be registered. Registration of the ribbon is such that for example, if printing of the Y color is followed by printing of the M color, the ink ribbon is fed (taken up) from a print end position for the Y color to a print start position for the M color to align a predetermined position on the ink ribbon with the print start position for the M color.

However, the amount by which the ribbon is fed during registration is not always constant. For example, if the card has been printed to the half thereof, the distance over which the ribbon needs to be fed for registration increases. In contrast, if the card has been entirely printed, the distance over which the ribbon needs to be fed decreases. Furthermore, the ink ribbon for Y includes a marker provided at a leading end thereof to register the ribbon. Thus, the printing of the ink ribbon for Y needs to be started from a more backward position than that of the ink ribbons for the other colors. Consequently, the distance from the print end position for the Y color to the print start position for the M color may decrease, thus reducing the distance over which the ribbon is fed for registration.

Moreover, the above marker may be provided between the M color and the C color within a predetermined image surface. This further reduces the distance from the print end position for the Y color to the print start position for the M color (see FIG. 10). Therefore, simply taking up the slack ink ribbon may displace the ink ribbon to affect the next color printing.

In view of these circumstances, an object of the present invention is to provide a printing apparatus and a ribbon registering method which enable the ink ribbon to be controllably registered according to the distance over which the ink ribbon is taken up to eliminate a slack in the ink ribbon having been slack as a result of printing and the distance from the print start position to the print start position for the next color.

Further objects and advantages of the invention will be apparent from the following description of the invention.

SUMMARY OF THE INVENTION

To accomplish the above-described object, a first aspect of the present invention is to provide a printing apparatus compressing a thermal head against a medium via an ink ribbon to print an image on the medium. The apparatus comprises a ribbon supply reel around which an unused portion of an ink ribbon is wound, a ribbon takeup reel around which a used portion of the ink ribbon is taken up, thermal head moving means for moving the thermal head between a print position and a retract position separated from the print position, takeup reel driving means for driving the ribbon takeup reel, ribbon position detecting means for detecting a position of the ink ribbon, medium registering means for registering the medium to the print position, and control means for performing control such that the ink ribbon is conveyed and driven so as to align a predetermined area of the ink ribbon with a print start position, according to a first distance over which the ink ribbon moves as a result of the takeup reel driving means driving the takeup reel in a direction in which a slack in the ink ribbon is eliminated, when printing is completed with the thermal head moved to the retract position, and a second distance between a print end position obtained by the ribbon position detecting means and a next print start position.

According to the first aspect, if the first distance is longer than the second distance, the control means controls such that the takeup reel driving means is driven to eliminate the slack in the ink ribbon, the medium registering means registers the medium to the print position, and the takeup reel driving means feeds back the ink ribbon by a length corresponding to a difference between the first distance and the second distance.

If the second distance is longer than the first distance, the control means controls such that the takeup reel driving means takes up the ink ribbon by a length corresponding to the second distance.

The first distance is shorter than a distance over which the thermal head moves from the print position to a standby position.

The ribbon position detecting means includes a transmission sensor and an encoder sensor detecting rotation of the supply reel.

A second aspect of the present invention is to provide a printing apparatus compressing a thermal head against a medium via an ink ribbon to print an image on the medium. The apparatus comprises a ribbon supply reel around which an unused portion of an ink ribbon is wound, a ribbon takeup reel around which a used portion of the ink ribbon is taken up, thermal head moving means for moving the thermal head between a print position and a retract position separated from the print position, takeup reel driving means for driving the ribbon takeup reel, ribbon position detecting means for detecting a position of the ink ribbon, medium registering means for registering the medium to the print position, and control means for performing control such that the ink ribbon is conveyed and driven so as to align a predetermined area of the ink ribbon with a print start position according to a first distance over which the ink ribbon moves as a result of the supply reel driving means driving the supply reel in a direction in which a slack in the ink ribbon is eliminated to take up the ink ribbon, when printing is completed with the thermal heat moved to the retract position, and a second distance between a print end position obtained by the ribbon position detecting means and a next print start position.

According to the second aspect, the control means controls such that the takeup reel driving means takes up the ink ribbon by a length obtained by adding the first distance and the second distance together.

The ribbon position detecting means includes a transmission sensor and an encoder sensor detecting rotation of the supply reel.

A printing method according to the present invention includes a thermal head moving step of moving a thermal head between a print position and a retract position separated from the print position, a ribbon position detecting step of detecting a position of an ink ribbon, a slack eliminating step of eliminating a slack in the ink ribbon when printing is completed to move the thermal head to the retract position, a medium registering step of registering a medium to the print position, and a ribbon registering step of registering the ink ribbon according to a first distance over which the ink ribbon moves during the slack eliminating step and a second distance between a print end position obtained during the ribbon position detecting step and a next print start position.

BRIEF DESCRIPTION OF THE DRAWINGS

FIGS. 10A, 10B, and 10C are diagrams showing a configuration of an ink ribbon according to the embodiment, wherein FIG. 10A shows that a front surface of a card is printed, FIG. 10B shows that printing of a Y color is stopped before reaching an end position for the Y color, and FIG. 10C shows that a registration mark is also provided between the Y color and an M color;

DETAILED DESCRIPTION OF THE PREFERRED EMBODIMENTS

With reference to the drawings, an embodiment will be described in which the present invention is applied to a printer apparatus including a function of printing and recording texts or images on a card-like recording medium (hereinafter simply referred to as a card) and a function of executing a magnetic recording process on a magnetic stripe portion of the card.

<System Configuration>

Figure 7:
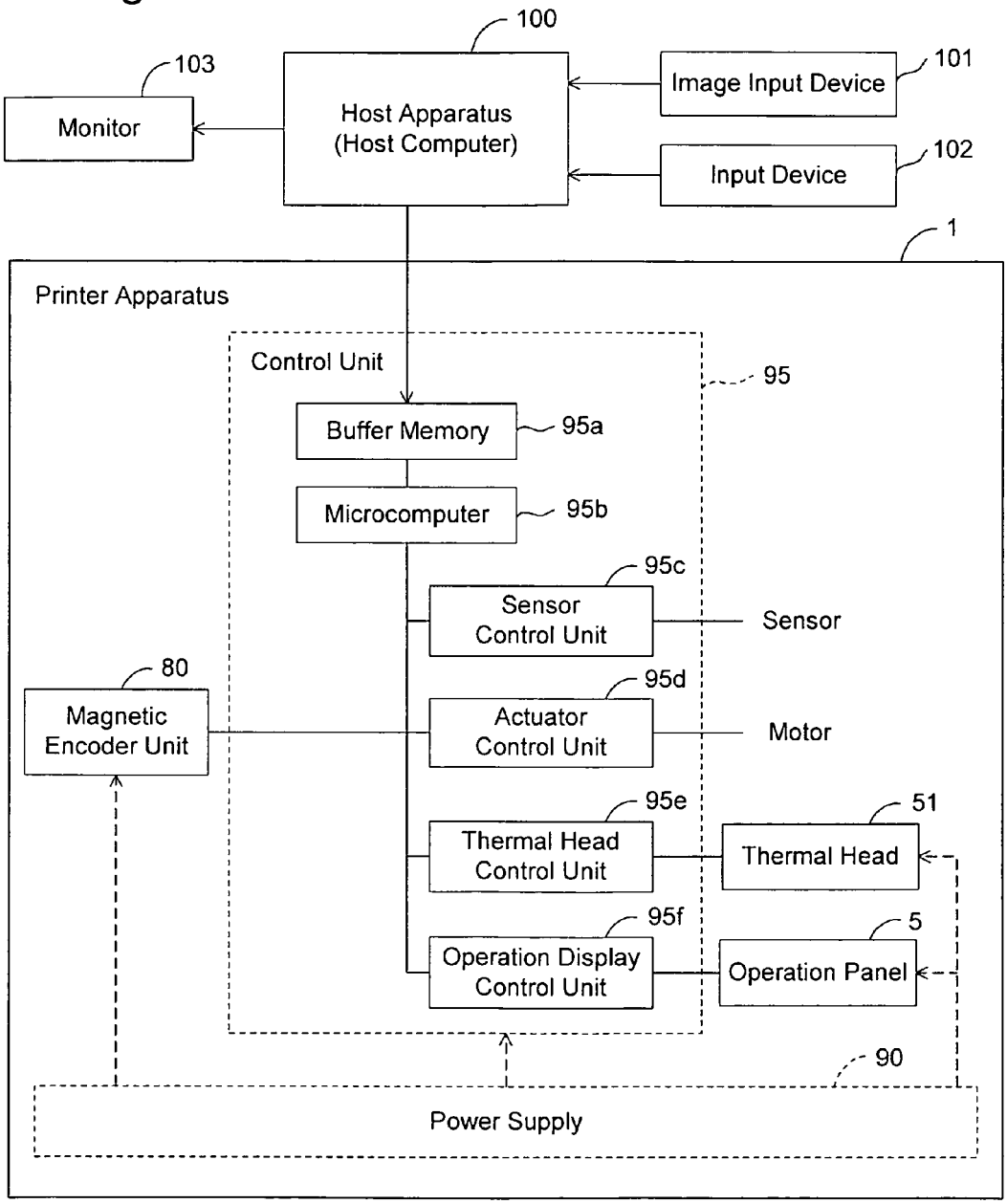
FIG. 7 is a block diagram showing a general configuration of a control section of the printer apparatus according to the embodiment.

As shown in FIG. 7, a printer apparatus 1 according to the present embodiment is connected to a higher-order apparatus 100 (for example, a host computer such as a personal computer) via an interface (not shown in the drawings) so that the upper apparatus 100 can transmit print recording data, magnetic recording data, or the like to the printer apparatus 1 to instruct the printer apparatus 1 to perform a recording operation or the like. As described below, the printer apparatus 1 includes an operation panel section (operation display section) 5 (see FIGS. 7 and 1) and is not only instructed by the higher-order apparatus 100 to perform the recording operation but also instructed via an operation panel section 5 to perform the recording operation.

The higher-order apparatus 100 is generally connected to an image input device 101 such as a scanner which reads images recorded on documents, an input device 102 such as a keyboard and a mouse which inputs instructions and data to the higher-order apparatus 100, and a monitor 103 such as a liquid crystal display which displays, for example, data generated by the higher-order apparatus 100.

<Configuration>

Figure 1:
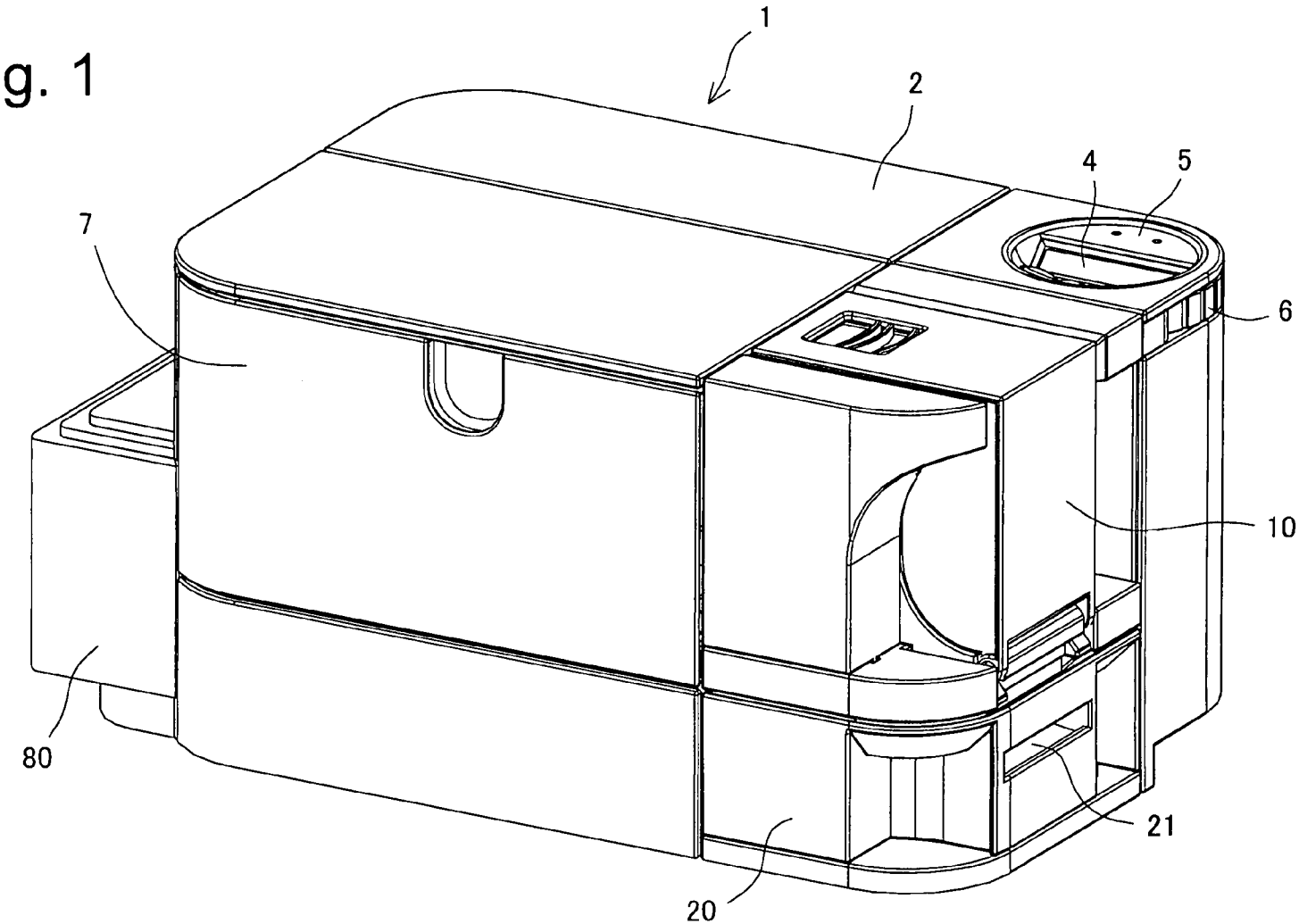
FIG. 1 is a perspective view of an appearance of a printer apparatus according to an embodiment to which the present invention is applicable.

As shown in FIG. 1, the printer apparatus according to the printer apparatus 1 of the present embodiment includes a card supply section 10 which is located on one side of a casing 2 serving as an apparatus housing and in which a plurality of (about 100) blank cards not yet subjected to a recording process can be housed in a stack, the card supply section 10 being removably attached to the casing 2, a card accommodating section 20 located on one side of the casing 2 and below the card supply section 10 and in which (about 30) cards already subjected to the recording process can be accommodated to be inclined, the card accommodating section 20 being removably attached to the casing 2, and the operation panel section 5 with a display section 4 located on the one side of the casing 2 and adjacent to the card supply section 10 to display an operational state of the printer apparatus 1 such as an error state. The operation panel section 5 allows various settings for a printing process and a magnetic recording process to be performed. The operation panel section 5 is provided so as to be rotatable in synchronism with a rotating dial 6.

A card emission port 21 is formed in a part of the card accommodating section 20 as an opening through which after the card accommodating section 20 becomes full, an excess card already subjected to the recording process can be discharged to the exterior of the apparatus. An opening and closing cover 7 is provided on one surface of the printer apparatus so as to allow the interior of the apparatus to be accessed when a cartridge 52 containing an ink ribbon R for use in print recording described below is installed or removed.

A basic configuration of the printer apparatus 1 is shown in U.S. patent application Ser. No. 12/003,260.

In the present embodiment, a printing section 50 adopts a configuration of a thermal transfer printer. The printing section 50 includes a thermal head 51 that is movable forward and backward with respect to a platen roller 44 provided at a print position on a card conveying path P1. An ink ribbon R is interposed between the platen roller 44 and the thermal head 51; a plurality of color ink layers Y (Yellow), M (Magenta), C (Cyan), Bk (Black), Op (protect layer), and the like are repeatedly provided in the ink ribbon R. The ink ribbon R is contained in the cartridge 52 as described above. The ink ribbon R is wound (held) around each of a supply reel 54 and a takeup reel 54 in the cartridge 52. The unused ink ribbon R is wound around the supply reel 54. The used ink ribbon R (already subjected to thermal transfer by the thermal head 51) is wound around the takeup reel 55.

To allow information such as a text or an image to print on a card C moving along a card conveying path P1, the ink ribbon R is fed from the ribbon supply reel 54 and conveyed with the substantially entire surface thereof in abutment with a tip portion of the thermal head 51. The ink ribbon R is then taken up around a ribbon takeup reel 55 configured to take up the ink ribbon R. The ribbon supply reel 54 and the ribbon takeup reel 55 are rotationally driven by a takeup reel driving motor 150. In this case, the thermal head 51 is pressed against a surface of the card C via the ink ribbon R, while heating elements in the thermal head 51 are selectively operated. A desired text or image is thus printed on the card. A plurality of guide shafts and a transmission sensor are disposed on a conveying path for the ink ribbon R, and the transmission sensor is made up of a light emitting element 58 and a light receiving element 59 to detect the ink layer Bk (Black) in order to register a predetermined ink layer (in the present embodiment, the ink layer Y).

An engaging section of an apparatus main body side corresponding to engaging sections 55A of the takeup reel 55 is composed of a plurality of members. That is, a support shaft 154 is fixed to an apparatus frame, and rotatably supports an engaging member 152 shaped like a disc and including a gear at an outer edge thereof. The engaging member 152 includes engaging projecting portions 152A that engage with the engaging sections 55A of the takeup reel 55.

Figure 8:
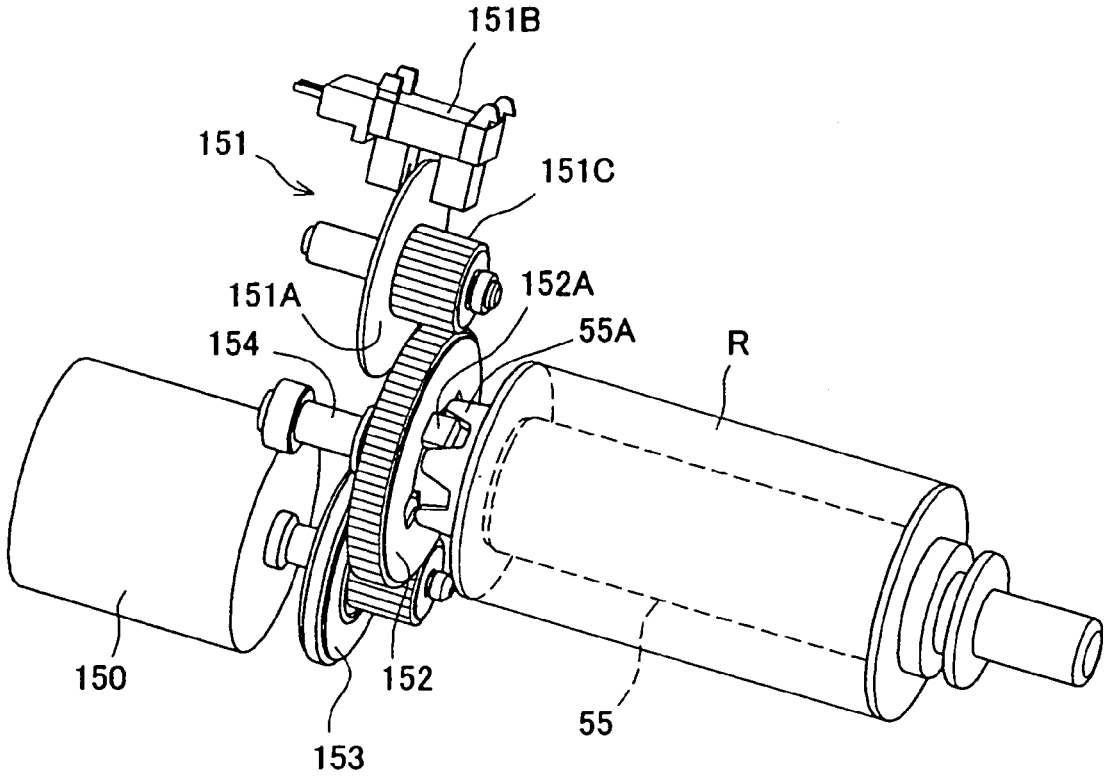
FIG. 8 is a perspective view of an appearance of an engaging section of the printer apparatus which engages a reel main body on a takeup reel side.

FIG. 8 shows how the engaging sections 55A of the takeup reel 55 engage with the engaging member 152 (engaging projecting portions 152A) on the apparatus main body side. A gear 151 meshes with a gear on the engaging member 152. A rotating plate 151A with a slit (not shown in the drawings) coaxially formed therein is secured to a gear 151C. An integral transition sensor 151B made up of a light emitting element and a light receiving element is located at a position where the rotating plate 151A is sandwiched between the light emitting element and the light receiving element. Thus, the rotating plate 151A and the sensor 151B form an encoder 151 that detects the rotation amount of the takeup reel 55, around which the ink ribbon R is taken up. A gear 153 meshes with a gear on the engaging member 154. A motor shaft of the takeup reel driving motor 150 (stepping motor) is coaxially fitted on the gear 153.

Thus, driving of the takeup reel driving motor 150 is transmitted to the takeup reel 55. The encoder 151 can then detect the rotation amount (the winding amount of the ink ribbon R and the feedback amount thereof described below) of the takeup reel 55.

Figure 9:
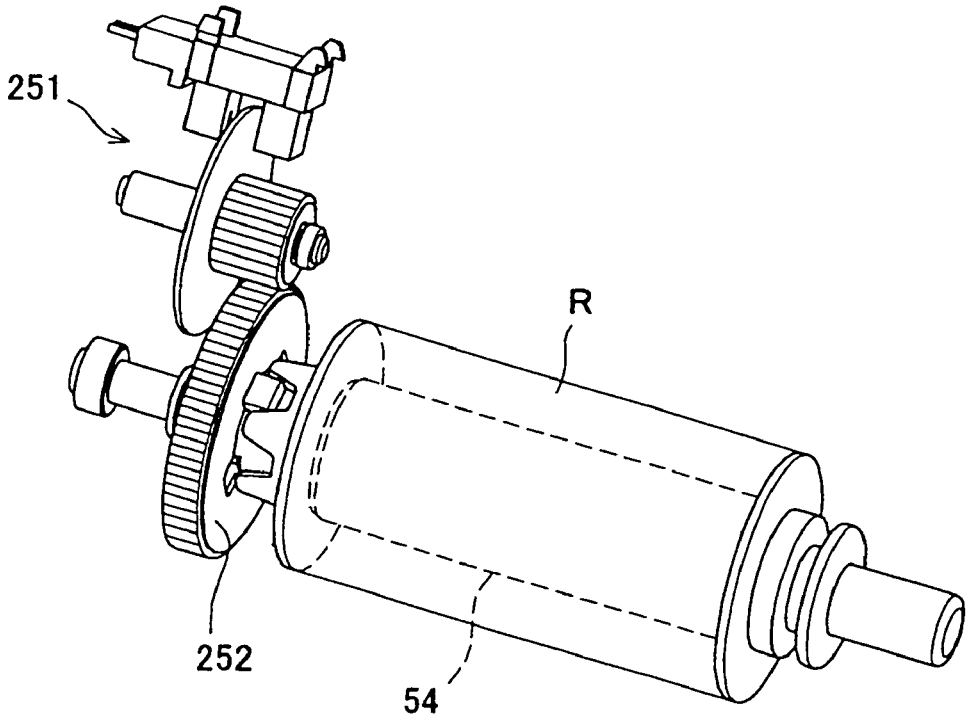
FIG. 9 is a perspective view of an appearance of an engaging section of the printer apparatus which engages a reel main body on a supply reel side.

On the other hand, as shown in FIG. 9, a coupling relationship between the supply reel 54 and the apparatus main body side is in principle the same as that between the takeup reel 55 and the apparatus main body side described above. However, the supply reel 54 side includes, instead of the gear 153 and the takeup reel driving motor 150 on the takeup reel 55 side, a gear meshing with the gear on the engaging member 252 and a torque limiter (not shown in the drawings) located on the gear to apply back tension to the ink ribbon R.

A transmission sensor (hereinafter referred to as a first detecting sensor) is disposed on an upstream side (conveying roller 43 side) of the thermal head 51 in a card conveying direction; the transmission sensor is made up of a light emitting element 48 and a light receiving element 49 to detect a leading end and a trailing end of the card C conveyed along the card conveying path P1.

A conveyance driving motor 70 is disposed in a lower part of the printing section 50 and made up of a forwardly and reversely drivable stepping motor that rotationally drives the series of conveying rollers 41, 42, and 43 and the platen roller 44 in a forward direction and a reverse direction. A rotational driving force of the conveyance driving motor 70 is transmitted, by a belt 72, to a pulley 73 via a pulley 71 provided around a rotating shaft of the conveyance driving motor 70. The driving is then transmitted to the platen roller 44 via a pulley 75 provided around a rotating shaft of the platen roller 44 by means of a belt 74 with one end thereof wound around the pulley 73. The pulley 73 is composed of a two-step pulley with the belts 72 and 74 installed on respective step portions.

A plurality of gears is disposed on the rotating shaft of the platen roller 44, on rotating shafts of the conveying rollers 41, 42, and 43, and among the rollers. The rotational driving force transmitted to the platen roller 44 is transmitted to the conveying rollers 41, 42, and 43 via the plurality of gears.

A nip roller 45 is provided on a downstream side (the ribbon takeup reel 55 side) of the platen roller 44 in the card conveying direction and along the card conveying path P1; the nip roller 45 includes a function of conveying the card C and sandwichingly holds the card C when the printing section 50 performs print recording on the card C. A feed roller 46 allowing the card C to be conveyed is provided on a further downstream side of the nip roller 45 in the card conveying direction. A transmission sensor (hereinafter referred to as a second card detecting sensor) is disposed substantially halfway between the nip roller 45 and the feed roller 46; the transmission sensor is made up of a light emitting element 56 and a light receiving element 57 to detect the leading end, in the conveying direction, of the card C being conveyed along the card conveying path P1.

A gear (not shown in the drawings) is also provided on a rotating shaft of each of the nip roller 45 and the feed roller 46. A plurality of gears (not shown in the drawings) is also provided between the platen roller 44 and the nip roller 45 and between the nip roller 45 and the feed roller 46. The plurality of gears (not shown in the drawings) meshes with one another to allow the rotational driving force of the conveyance driving motor 70 to diverge from the gear provided on the rotating shaft of the platen roller 44 to the nip roller 45 and the feed roller 46 via a driving force transmitting mechanism including the above-described pulleys, belts, and plurality of gears (not shown in the drawings).

Figure 2:
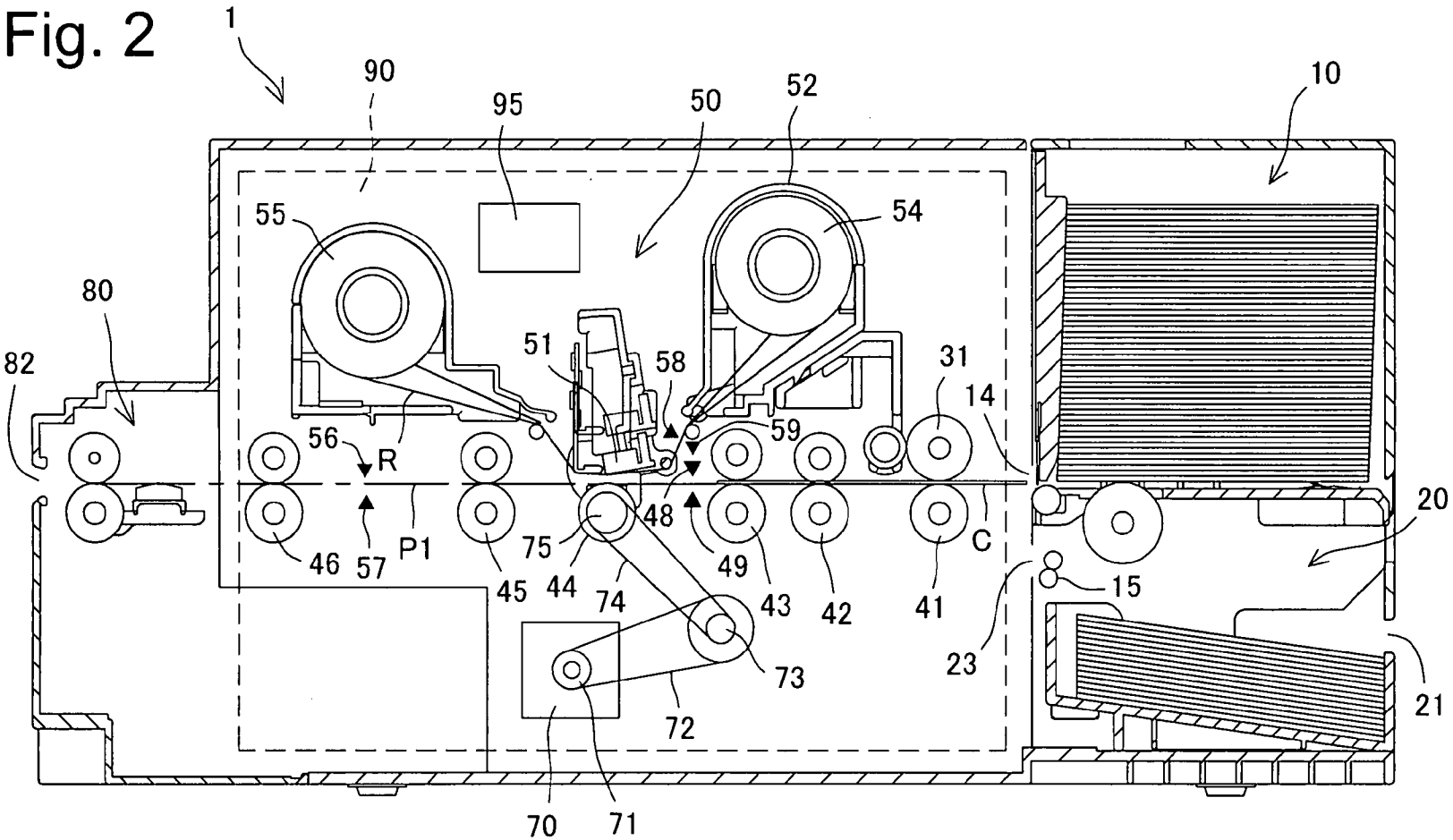
FIG. 2 is a schematic sectional view showing that a blank card not subjected to a recording process yet is carried into the printer apparatus according to the embodiment.
Figure 3:
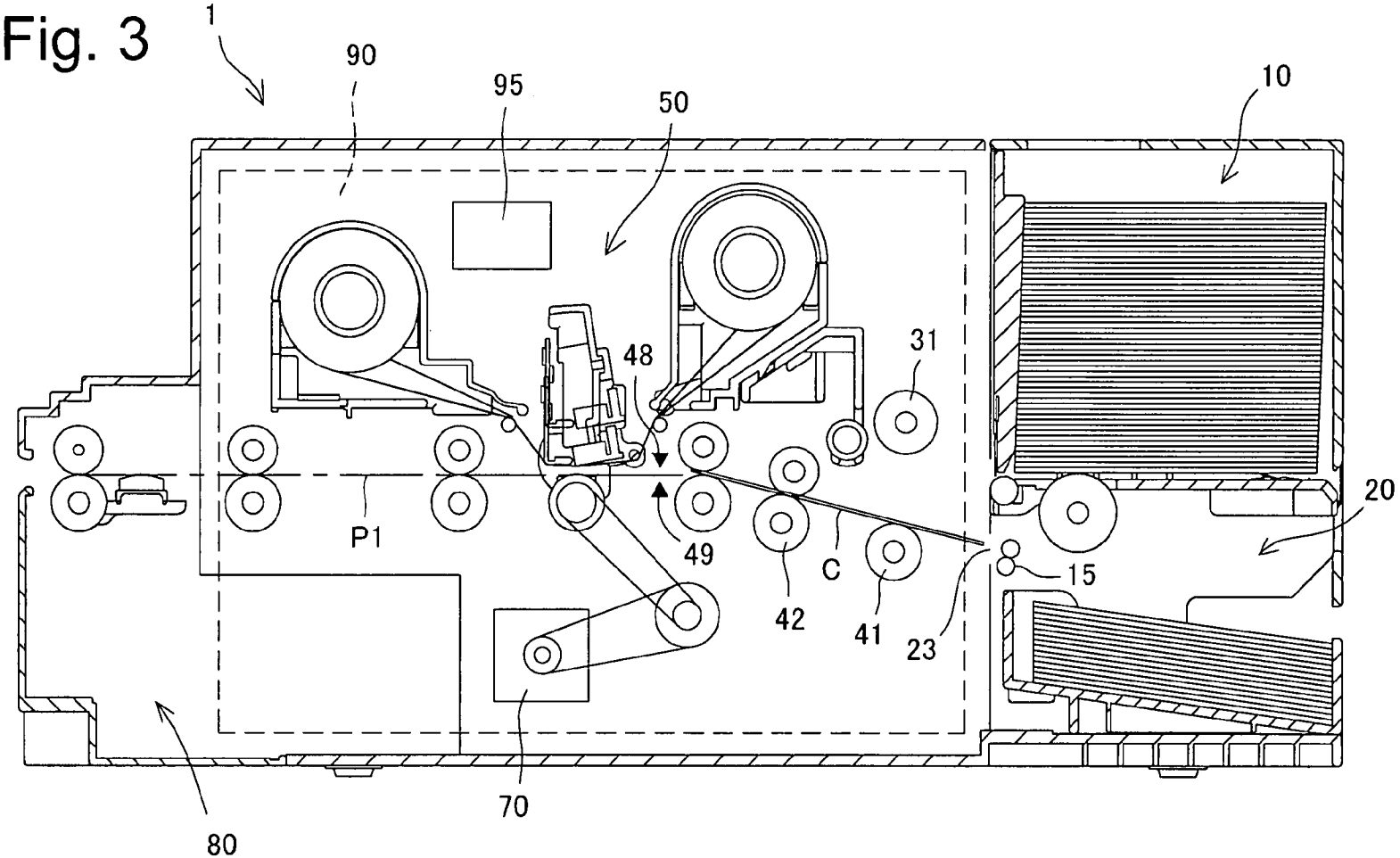
FIG. 3 is a schematic sectional view showing that the card already subjected to the recording process is discharged from the printer apparatus according to the embodiment.

Now, a control system and an electric system of the printer apparatus will be described. As shown in FIGS. 2 and 3, the printer apparatus 1 includes a control section 95 that controls the operation of the whole printer apparatus and a power supply section 90 that converts a commercial AC power supply into a DC power supply that allows the mechanical sections, the control section, and the like to be driven and operated.

<Control Section>

As shown in FIG. 7, the control section 95 includes a microcomputer 95*b* that executes a control process on the whole printer apparatus 1. The microcomputer 95*b* is composed of a CPU that operates according to a high-speed clock as a central processing unit, a ROM that stores basic control operations (programs and program data) of the printer apparatus 1, a RAM that works as a work area for the CPU, and an internal bus that connects the CPU, the ROM, and the RAM together.

An external bus is connected to the microcomputer 95*b*. A buffer memory 95*a* is connected to the external bus to temporarily store, for example, an interface (not shown in the drawings) that allows communication with the higher-order apparatus 100, print recording data to be printed on the card C, and magnetic recording data to be magnetically recorded in a magnetic stripe portion of the card C.

The external bus also is connected to a sensor control section 95*c* that controls signals from various sensors, an actuator control section 95*d* controlling, for example, motor drivers that transmit driving pulses or driving power to motors, a thermal head control section 95*e* controlling thermal energy of the thermal head 51, an operation display control section 95*f* controlling the operation panel section 5, and a magnetic encoder unit 80. The sensor control section 95*c* is connected to the first card detecting sensor, made up of the light emitting element 48 and the light receiving element 49, the second card detecting sensor, made up of the light emitting element 56 and the light receiving element 57, and other sensors (not shown in the drawings). The actuator control section 95*d* is connected to a stepping motor 61, the conveyance driving motor 70, and other motors (not shown in the drawings), and an actuator 34 and the like. The thermal head control section 95*e* is connected to the thermal head 51. The operation display control section 95*f* is connected to the operation panel section 5.

The power supply section 90 supplies an operating/driving power to the control section 95, the thermal head 51, the operation panel section 5, and the magnetic encoder unit 80 (see FIG. 7).

(Operation)

Now, the printing process operation of the printer apparatus 1 according to the present embodiment will be described mainly in conjunction with the CPU of the microcomputer 95*b* (hereinafter simply referred to as the CPU).

For operations of the printer apparatus 1 other than the printing process, see U.S. patent application Ser. No. 12/003,260.

A printer driver installed in the higher-order apparatus 100 determines various parameters required to control the recording operation of the printer apparatus 1 based on a recording instruction specified by an operator (user). Based on the recording instruction, the printer driver generates and transmits print recording data and magnetic recording data to be recorded on the card, to the printer apparatus 1. The buffer memory 95*a* of the control section 95 stores various parameter values serving as recording control instructions, image data or text data obtained by decomposing print recording data into color components Y, M, C, and Bk, and magnetic recording data. In the present embodiment, the higher-order apparatus 100 decomposes the original data (R, G, and B) into the color components, and the printer apparatus 1 converts the color components R, G, and B into Y, M, and C and uses the resulting color components as image data. Bk data extracted by the higher-order apparatus is used in the printer apparatus 1 as Bk data for text data.

<Ribbon Registration>

The CPU registers the ink ribbon R by driving the takeup reel driving motor 150 via the actuator control section 95*d* to take up the ink ribbon R in the cartridge 52 toward the ribbon takeup reel 55. Thus, the ink ribbon R is registered such that for example, a predetermined position on the ink layer Y (Yellow) is located at a print start position before the start of printing.

The CPU drives the takeup reel driving motor to take up the ink ribbon R in the cartridge 52 toward the ribbon takeup reel 55. The CPU further allows an encoder sensor 251 to detect the rotation amount (that is, the number of steps taken by the takeup reel driving motor 150) by which the supply reel 54 rotates from a point when the transmission sensor made up of the light emitting element 58 and the light receiving element 59 detects an end of the ink layer Bk (Black) (when the light receiving element 59 detects that light emission from the light emitting element 58 associated with the ink layer Bk has changed from a non-transmission condition to a transmission condition) to a point when the transmission sensor detects a terminal portion of the ink layer Bk. The CPU then stores the rotation amount in the RAM and calculates the current ribbon position and the print start position for each color for the next image surface.

Thereafter, the ink ribbon R is further taken up. When a ribbon registration mark R1 provided between the protect layer Op and the ink layer Y is detected, the takeup reel driving motor 150 starts to further drive. The takeup reel driving motor 150 is driven by a predetermined number of steps to move the ink ribbon R to the print start position.

Figure 10A:
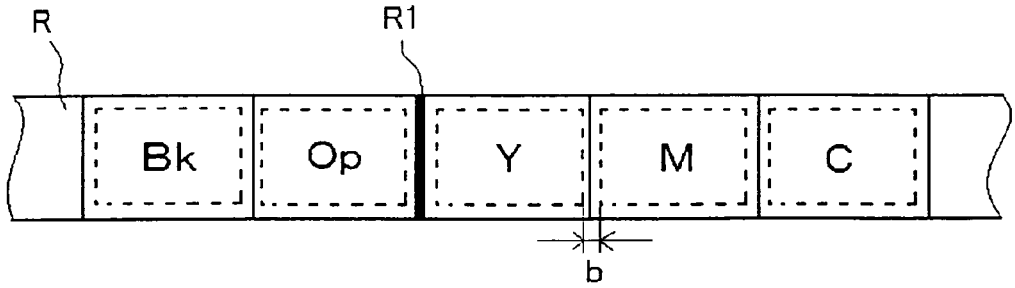
Figure 10B:
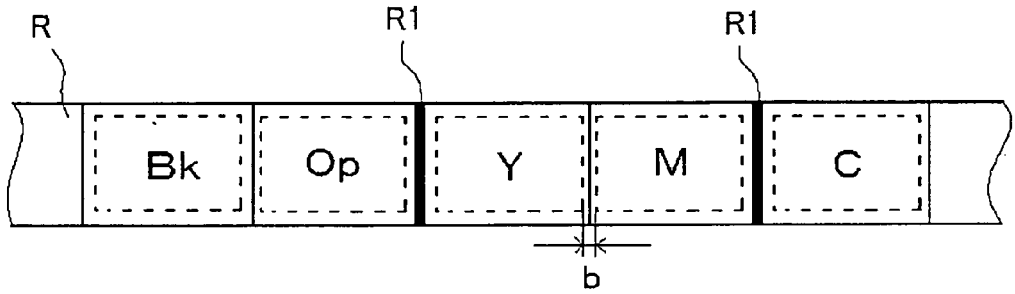
Figure 10C:
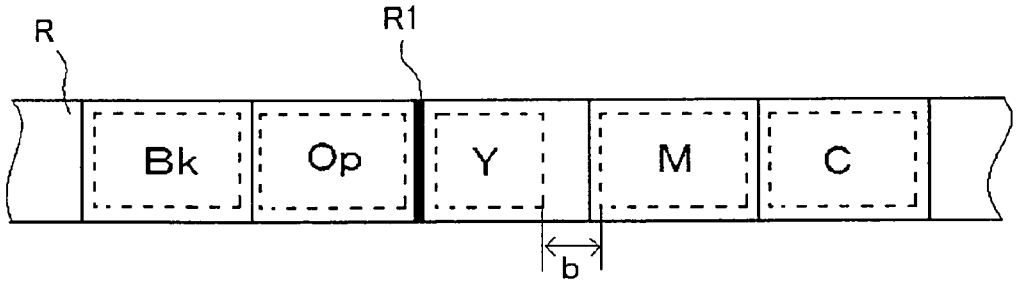

The number of steps taken by the takeup reel driving motor 150 is also counted during printing. Thus, the distance b (see FIG. 10. Dashed lines in the figure show print ranges) from the ribbon position where the printing is completed to the ribbon position where the next printing is started can be easily calculated. Specifically, for example, the amount by which the takeup reel driving motor needs to be driven from a print end position for the Y color to the print start position for the M color can be calculated by determining a difference between the number of steps taken by the takeup reel driving motor 150 from the ribbon registration mark R1 to the print end position for the Y color and the number of steps taken by the takeup reel driving motor from the print end position for the Y color to the print start position for the M color. The print end position refers to a position where the ink ribbon R is peeled off from the card C after printing has been completed.

<Card Registration>

The CPU drives the conveyance driving motor 70 forward to convey the card on the card conveying path P1 toward a card carry-out port 82. The CPU further allows the first card detecting sensor made up of the light emitting element 48 and the light receiving element 49 to detect the leading end position of the card C. The CPU thereafter further drives the conveyance driving motor 70 by a predetermined number of steps from the position of the detection to align the leading end of the card C with the print position.

To print the next color image on the card C, the conveyance driving motor 70 is reversely driven to covey the card C toward the card supply section 10. Once the card C reaches a predetermined position, the conveyance driving motor 70 is driven forward again to convey the card C toward the print position. Thereafter, to align the card C with the print position, a procedure similar to the one described above is carried out.

<Transfer Printing Process>

Then, the printing section 50 prints a desired text or image on the surface of the card C based on the print recording data. That is, with the ink ribbon R (for example, the portion of the ink layer Y) placed on the surface of the card C, the CPU drives a thermal head elevating and lowering motor 300 via the actuator control section 95*d* to press the thermal head 51. At the same time, the CPU selectively operates the heating elements of the thermal head 51 according to Y color image data (image data on a Y component obtained by subjecting RGB data to color conversion). Thus, a Y (Yellow) thermal-transfer ink component coated on the ink ribbon R is transferred directly to the surface of the card C.

At this time, a back surface side of the card C is supported by the platen roller 44. First, the card C is sandwichingly conveyed by the conveying rollers 42 and 43 and then conveyed on the card conveying path P1 toward the card carry-out port 82. During the conveyance, the leading end side of the card C is sandwichingly held by the nip roller 45, whereas the trailing end side of the card C is sandwichingly held by the conveying roller 43. Finally, with the back surface side of the trailing end side of the card C supported by the platen roller 44, the card C is sandwichingly held by the nip roller 45. Thus, during the print recording by the printing section 50, the conveying rollers 42 and 43 and the nip roller 45 function as a capstan roller that sandwichingly holds and conveys the card C at a constant speed. The CPU allows the card detecting sensor made up of the light emitting element 49 and the light receiving element 49 to detect the position of the trailing end of the card C. The CPU continues to drive the conveyance driving motor 70 forward by an amount corresponding to a predetermined number of pulses and then stops driving the conveyance driving motor 70.

Figure 12:
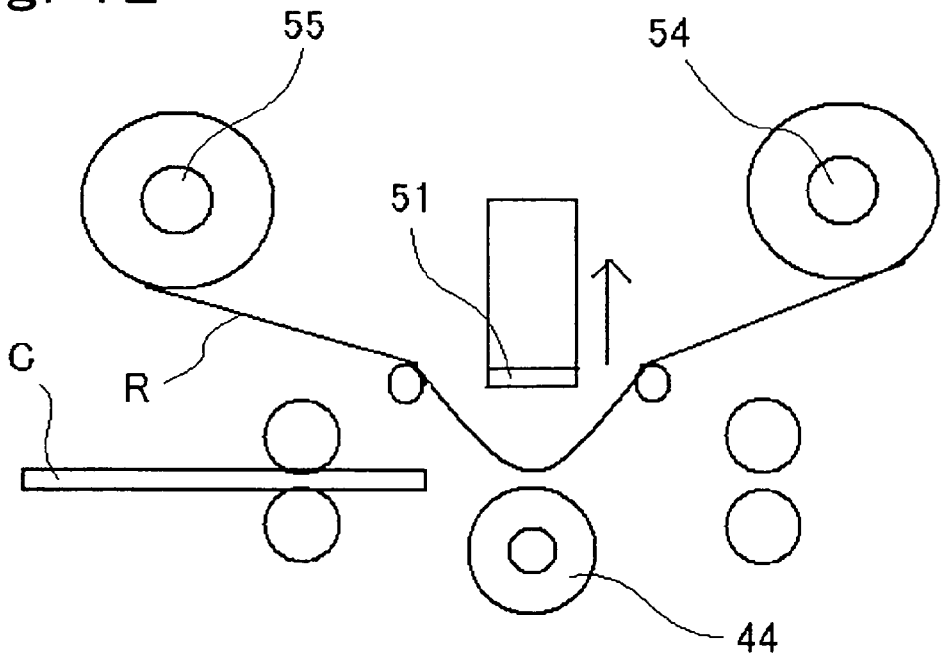
FIG. 12 is a diagram illustrating the printing operation according to the embodiment and showing that the ink ribbon has been slack as a result of printing.

Once printing of the Y color is completed, the CPU drives the thermal head elevating and lowering motor 300 to retract the thermal head 51 in order to register the ink ribbon R for the next color and the card C. When the thermal head 51 is retracted, the ink ribbon R becomes slack by an amount corresponding to the distance (in the present embodiment, 4 mm) over which the thermal head 51 has moved (FIG. 12).

Figure 23:
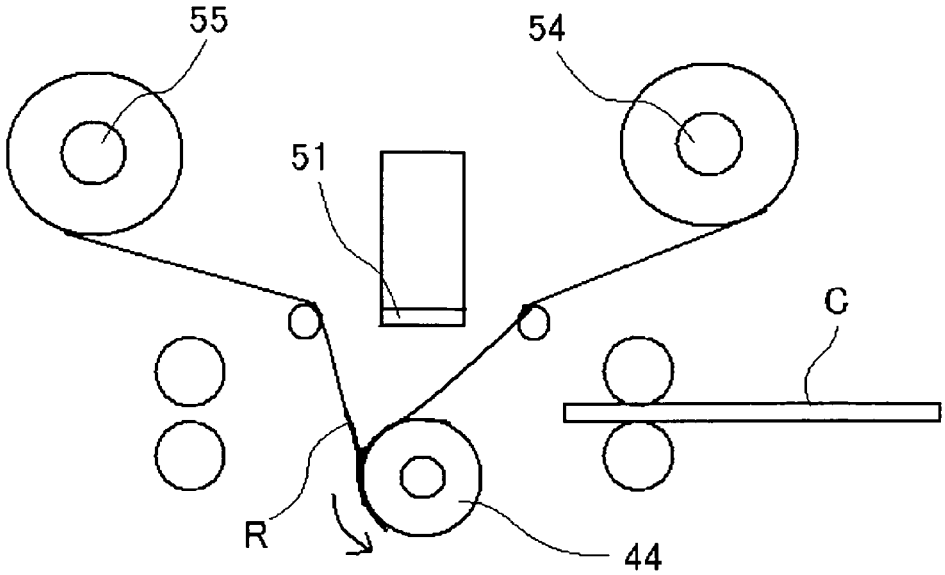
FIG. 23 is a diagram showing that a slack ink ribbon twines around a platen roller in a conventional printing apparatus.

In this condition, when the platen roller 44 is rotated to register the card C, the ink ribbon R may twine around the platen roller 44 owing to static electricity (FIG. 23). To prevent this, the ink ribbon R needs to be separated from the platen roller 44 by taking up the ink ribbon R to eliminate the slack therein. However, simply taking up the ink ribbon R may affect ribbon registration for the next color printing. Thus, the ribbon needs to be registered by comparing a distance (a) by which the ink ribbon R needs to be taken up to eliminate the slack therein, with the above-described distance (b).

<Printing Process>

Figure 15:
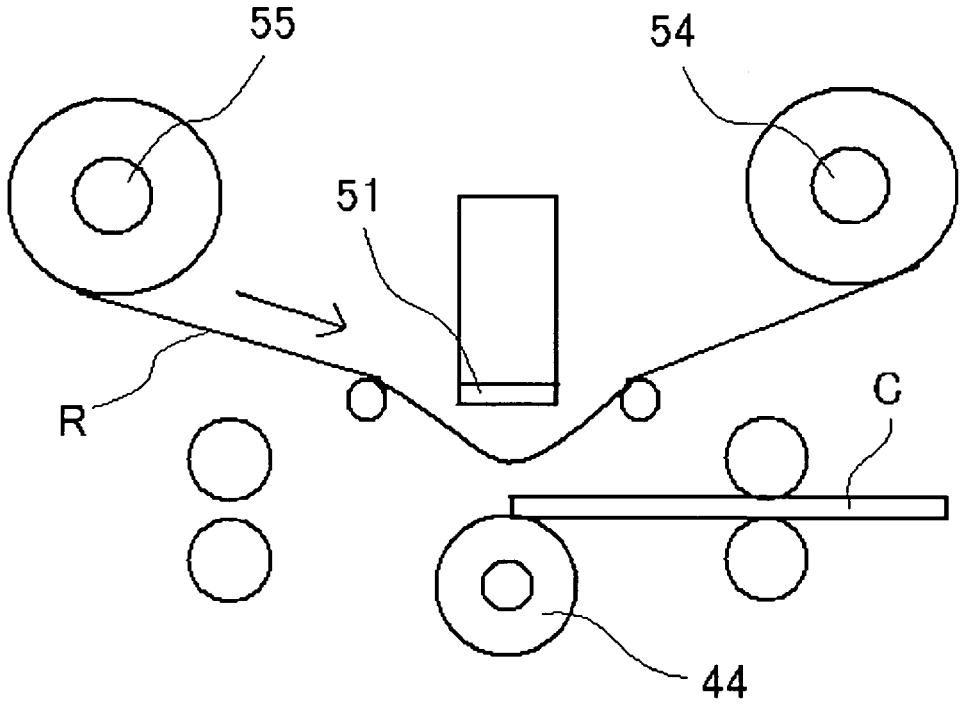
FIG. 15 is a diagram illustrating the printing operation according to the embodiment and showing that the ink ribbon has been fed back.
Figure 16:
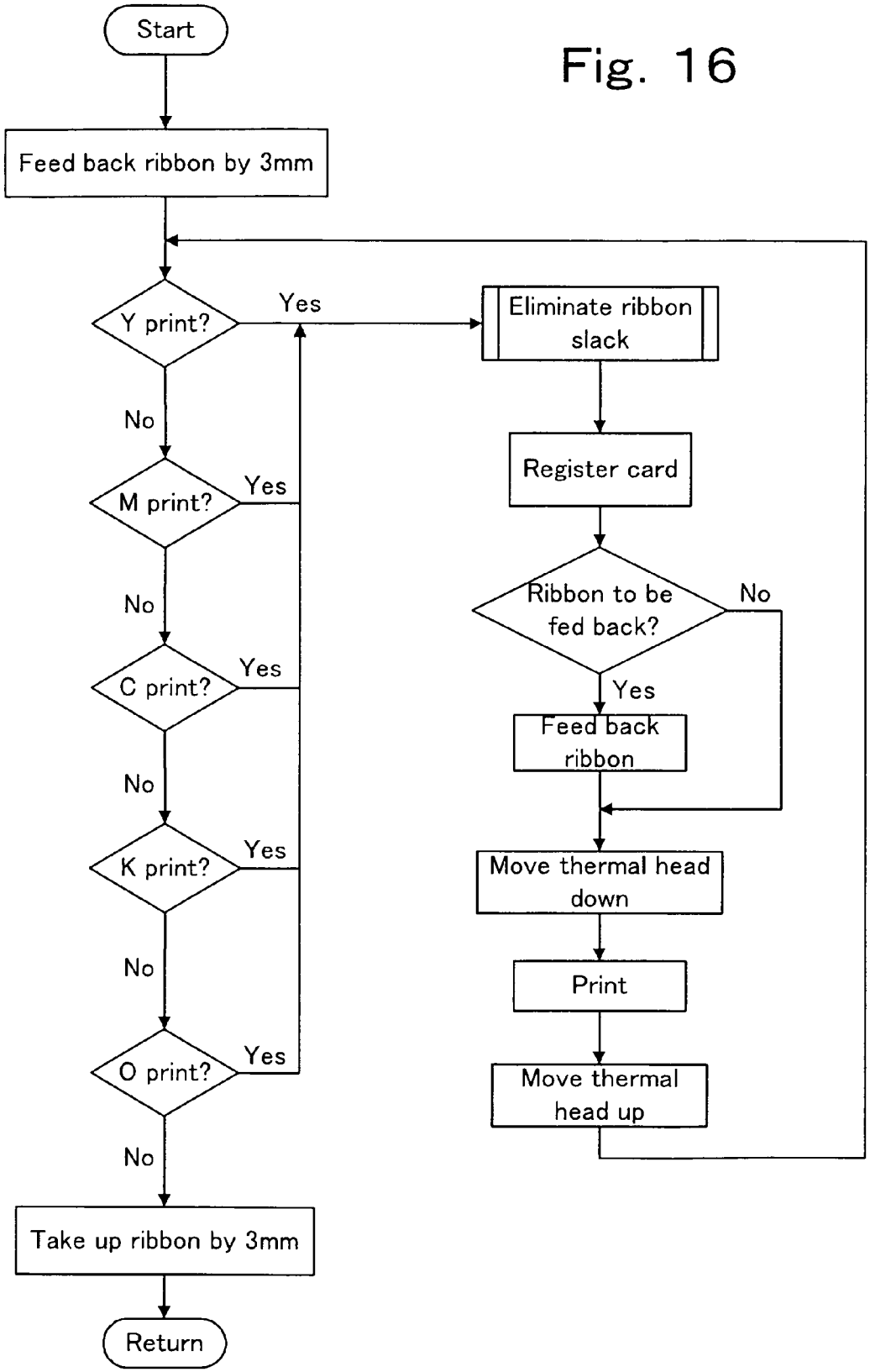
FIG. 16 is a flowchart illustrating a flow of the printing operation according to the embodiment.
Figure 17:
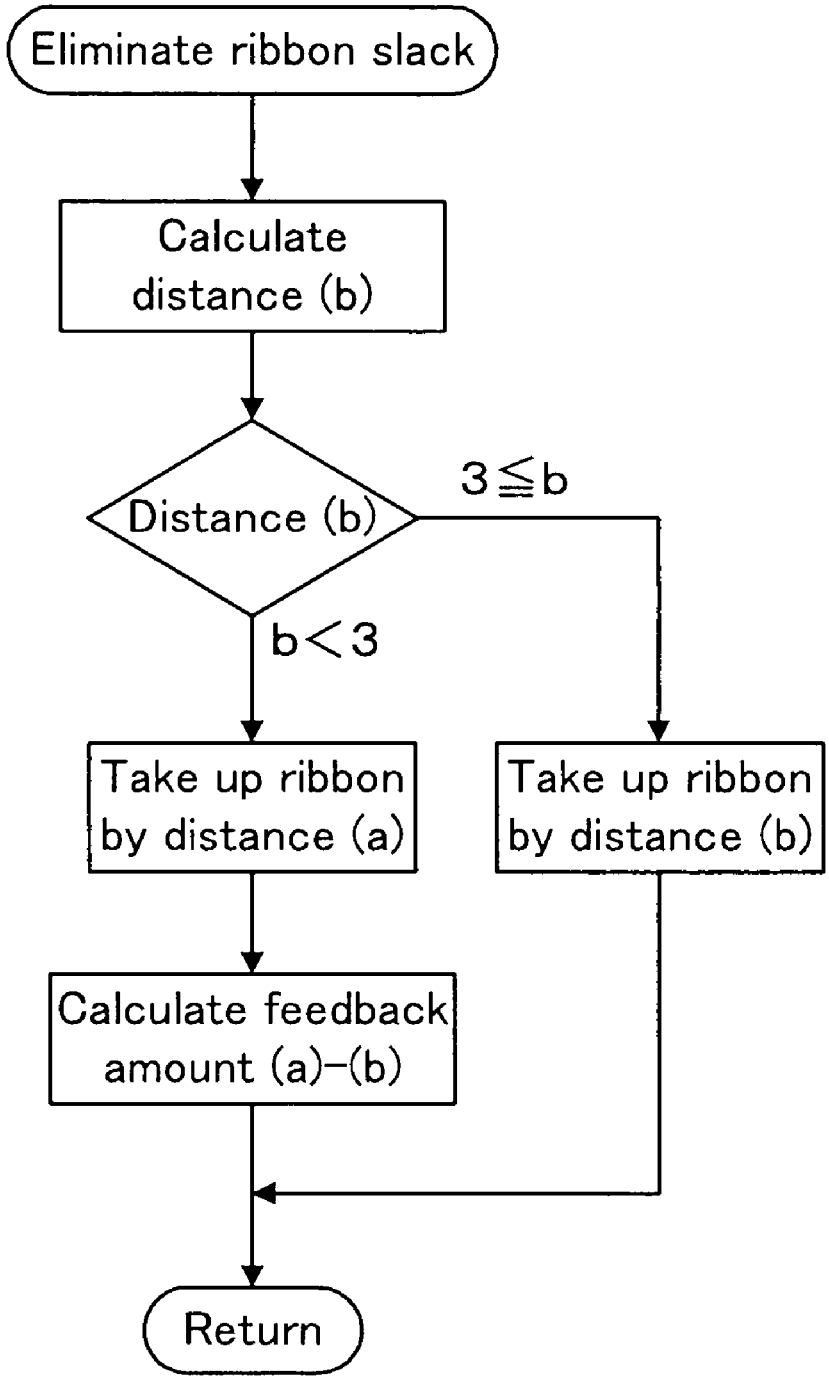
FIG. 17 is a flowchart illustrating a slack eliminating step in FIG. 16.

A flow of the printing process will be described below. FIG. 15 shows the flow of the entire printing operation. The expression "take up the ink ribbon R" hereinafter refers to an operation in which the CPU drives the takeup reel driving motor forward to take up the ink ribbon R. The expression "feed back the ink ribbon R" hereinafter refers to an operation in which the CPU reversely drives the takeup reel driving motor to feed back the ink ribbon R.

First, the card C is fed through the card supply port. Thereafter, the ink ribbon R is fed back by the predetermined distance (a) (in the present embodiment, 3 mm: the amount required to eliminate the slack in the ink ribbon R). The ink ribbon R is then registered. Then, the distance (b) from the current ribbon position (for the first printing, the position where a trailing end of the ink layer Bk is detected by the transmission sensor made up of the light emitting element 58 and the light receiving element 59) to the ribbon position where printing is started (in the present embodiment, the position where printing of the Y color is started because the Y color is first printed) is calculated. When the distance (b) is less than 3 mm, the ink ribbon R is taken up by 3 mm, and a ribbon feedback amount is set to (3−b) mm. In contrast, when the distance (b) is at least 3 mm, the ink ribbon R is taken up by the distance (b).

In this condition, the ink ribbon R is not slack. Thus, the card C is conveyed for registration. Thereafter, if the ink ribbon R needs to be taken up, the ink ribbon R is taken up by the calculated distance (3−b) mm.

Figure 13:
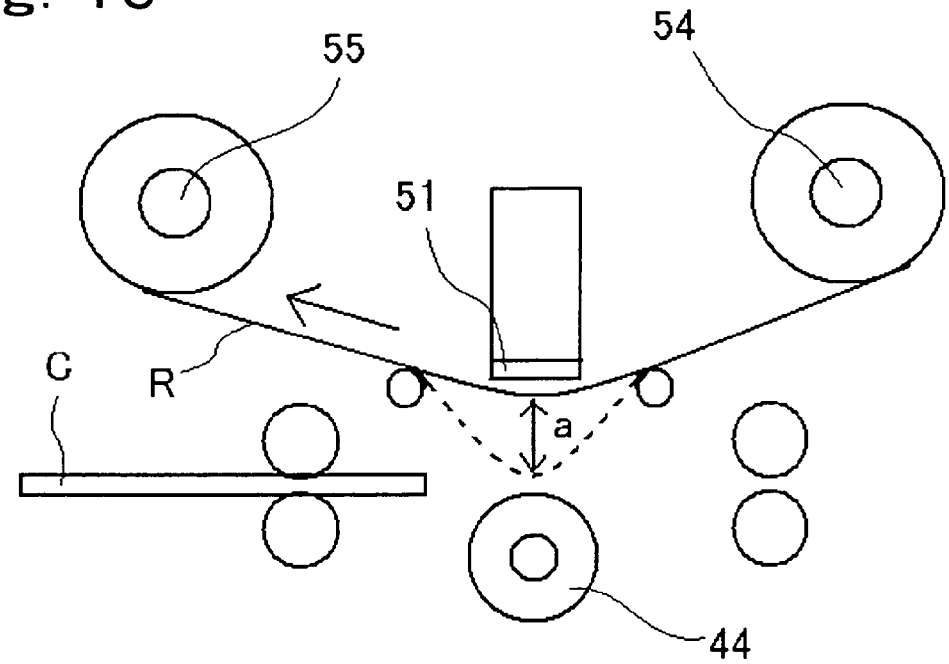
FIG. 13 is a diagram illustrating the printing operation according to the embodiment and showing that the slack has been eliminated.

When printing of the Y color is completed, the thermal head 51 is elevated to the retract position. At this time, the ink ribbon R becomes slack by the distance (in the present embodiment, 4 mm) over which the thermal head 51 has moved (FIG. 12). Thus, if the M (Magenta) color is to be printed next, the ribbon registration is performed. Then, as described above, the distance (b) from the current position of the ink ribbon R (Y print end position) to the M print start position is calculated. If the distance (b) is less than 3 mm, the ink ribbon R is taken up by 3 mm, and the ribbon feedback amount of (3−b) mm is stored in the RAM. In contrast, if the distance (b) is at least 3 mm, the ink ribbon R is taken up by the distance b (FIG. 13).

Figure 11:
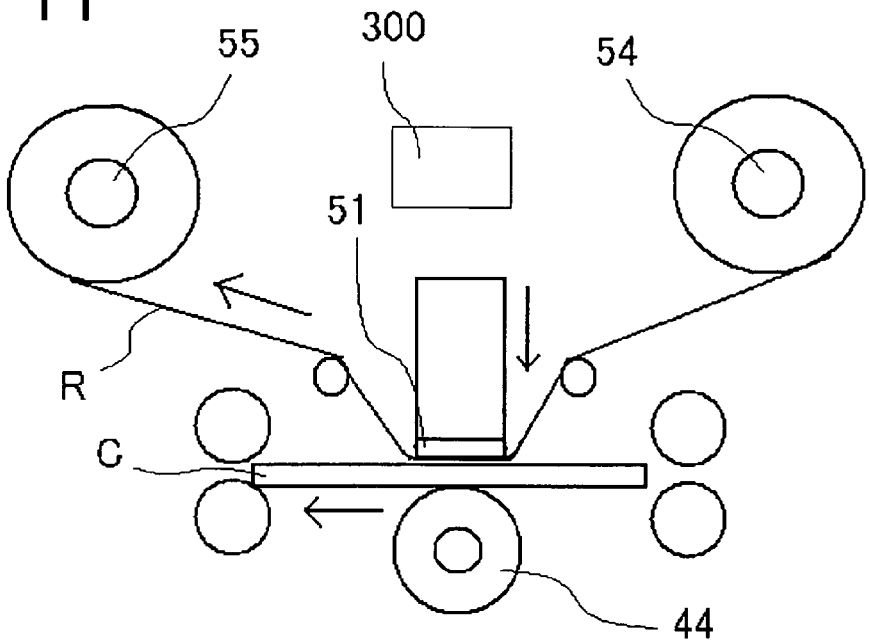
FIG. 11 is a diagram illustrating a printing operation according to the embodiment and showing that the printing operation is being performed.
Figure 14:
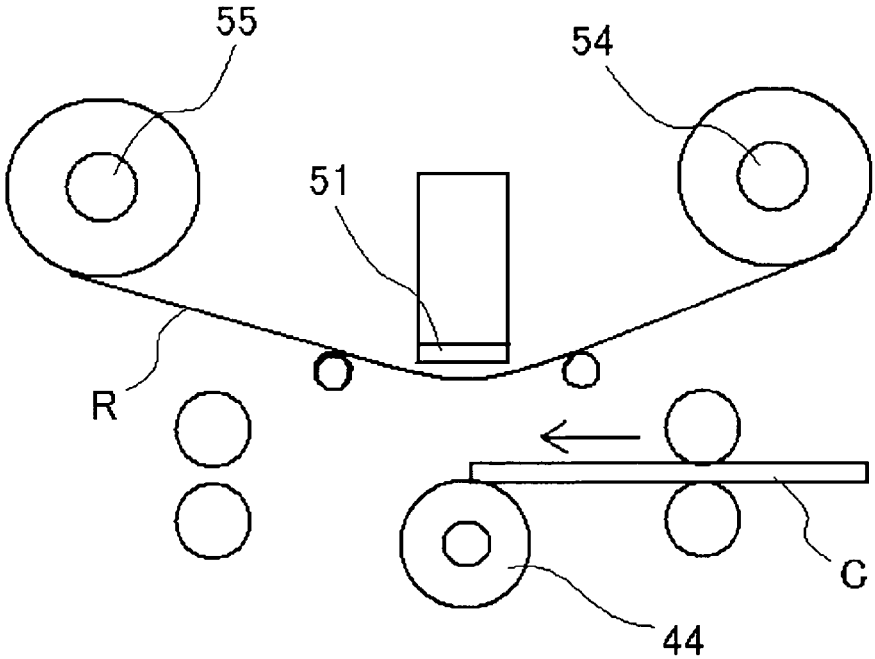
FIG. 14 is a diagram illustrating the printing operation according to the embodiment and showing that the card has been registered.

Thereafter, the card C is registered (FIG. 14). If the ink ribbon R needs to be fed back, the ink ribbon R is fed back by the distance of (3−b) mm, stored in the RAM (FIG. 15). The thermal head 51 is lowered to the print position, and printing of the M color is started (FIG. 11). When the printing of the M color is completed, the thermal head 51 is elevated to the retract position. The ink ribbon R becomes slack again as described above (FIG. 12).

To subsequently print the C (Cyan) color, the Bk (Black) color, and the Op (protect layer), operations similar to those of the process of printing the M (Magenta) color are performed.

If for example, the distance from the M print end position to the C print start position is at least 3 mm, the ribbon registration has been completed because the ink ribbon R is taken up by the distance (b) when the slack in the ink ribbon R is eliminated. Thus, after the card registration, printing of the card C is immediately started without the need to take up the ink ribbon R (FIG. 11→FIG. 12→FIG. 13→FIG. 14→FIG. 11).

Finally, the Op (protect layer) is printed. Then, to allow the card C to be discharged, the ink ribbon R is taken up by 3 mm to eliminate the slack in the ink ribbon R to complete the printing process.

All of the Y, M, C, Bk, and Op are not printed. Thus, when the ink ribbon R is registered, a color not to be printed is skipped and the ink ribbon R is set for the next color. Furthermore, when printing of one card C is completed, the ink ribbon R is taken up by 3 mm, and the card C is discharged to complete the printing process. Additionally, in the present embodiment, when the ink ribbon R becomes slack by 4 mm, the ink ribbon R is taken up by 3 mm in order to eliminate the slack in the ink ribbon R. However, the amount by which the ink ribbon R is taken up to eliminate the slack in the ink ribbon R has only to be at least 4 mm. However, the ink ribbon R needs to be taken up by a distance sufficient to prevent the slack ink ribbon R from twining around the platen roller 44 owing to static electricity. In this case, the distance over which the ink ribbon R is taken up to eliminate the slack in the ink ribbon R is denoted by (a). Thus, a color image (including the protect layer) of the Y, M, C, Bk, and Op is formed on the surface of the card C.

Figure 4:
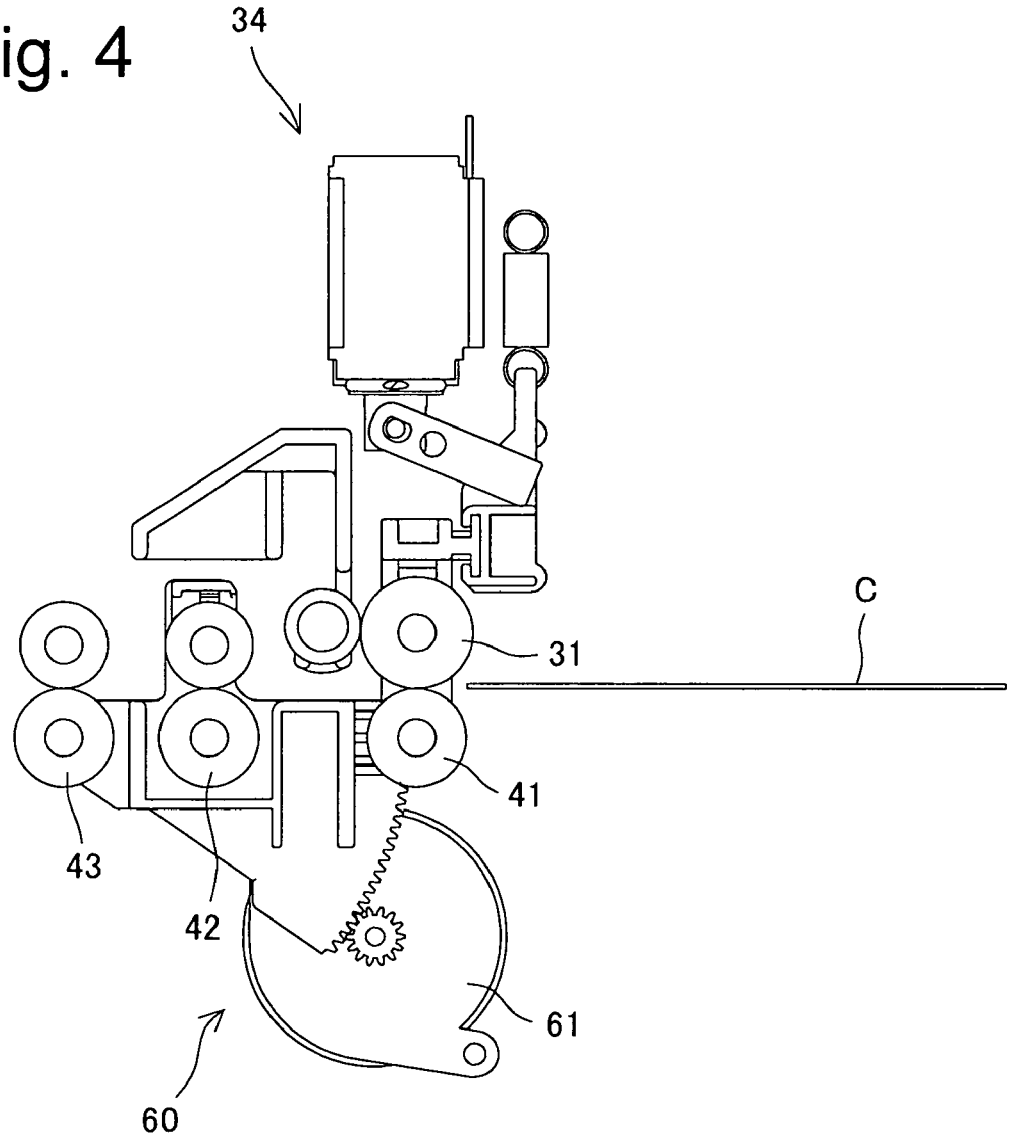
FIG. 4 is a partly enlarged view illustrating operations of a conveying roller moving mechanism and a card cleaning mechanism, wherein a card is received.
Figure 5:
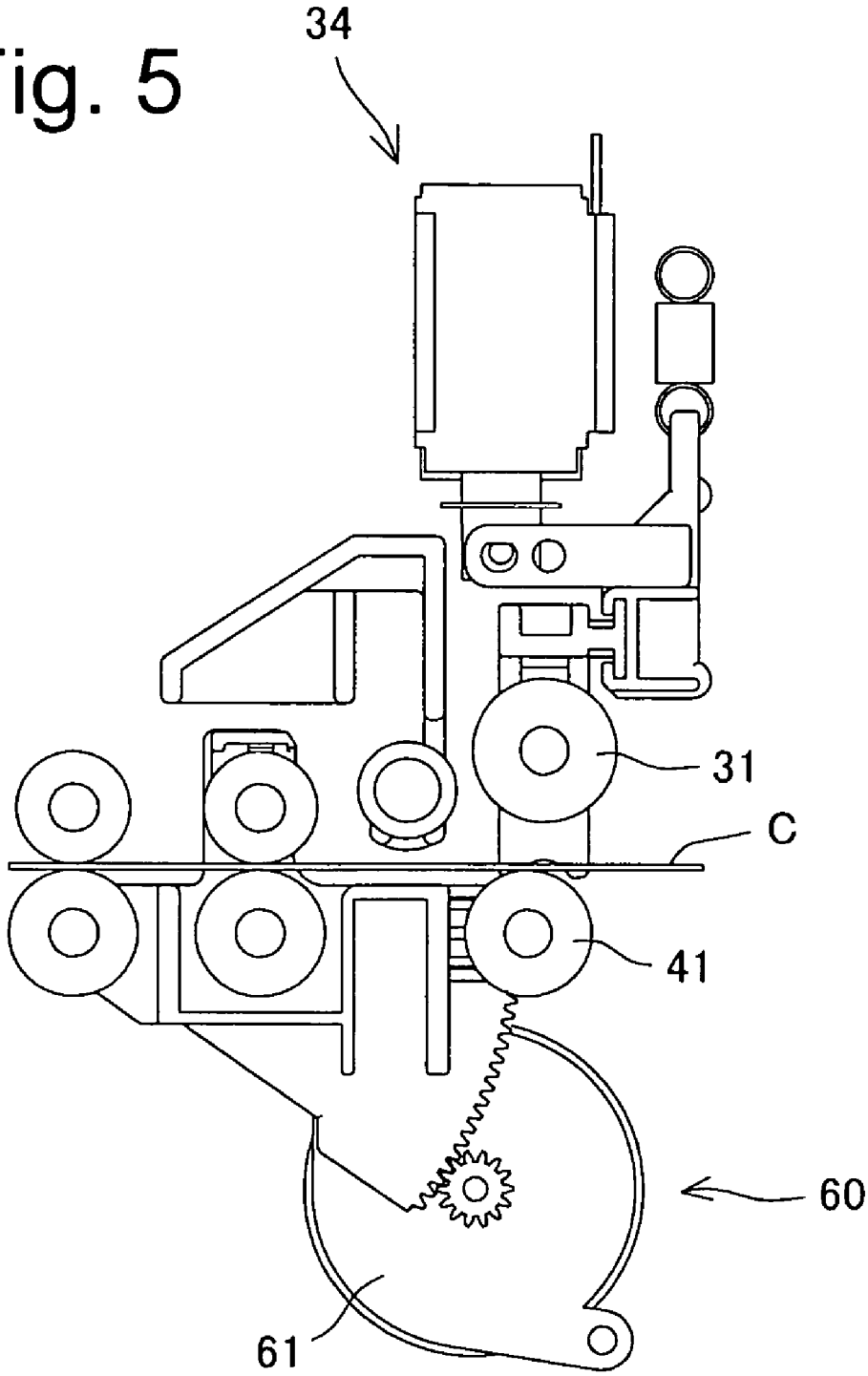
FIG. 5 is a partly enlarged view illustrating the operations of the conveying roller moving mechanism and the card cleaning mechanism, wherein the card is reversely conveyed for multicolor field-sequential printing.

Then, the CPU conveys the card C toward the card discharge port 23. That is, the CPU reversely drives the conveyance driving motor 70 to reversely convey the card C along the card conveying path P1 toward the card supply port 14. As shown in FIGS. 4 and 5, when the printing section 50 performs multicolor field-sequential print recording on the print surface of the card C and when the card C is reversely conveyed toward the card supply port 14 side (the condition shown in FIG. 5), the conveying rollers 41 and 42 are held at a first position where the conveying rollers 41 and 42 are located so as to form a substantially horizontal card conveying path. However, to discharge the card C already subjected to the predetermined recording process, toward the card discharge port 23, the CPU uses, as a trigger, a point when the card detecting sensor made up of the light emitting element 48 and the light receiving element 49 detects the trailing end of the card C being reversely conveyed on the card conveying path P1 or a point corresponding to a number of pulses after the detection of the trailing end of the card C, to drivingly control the stepping motor 61 to allow a moving mechanism 60 (driving of a stepping motor 61) to move the conveying rollers 41 and 42 to a second position where the conveying rollers 41 and 42 are positioned so as to form an inclined card conveying path. The CPU further reversely drives the motor (not shown in the drawings) that rotationally drives the above-described supply roller 11, to rotationally drive the discharge roller 15.

Figure 6:
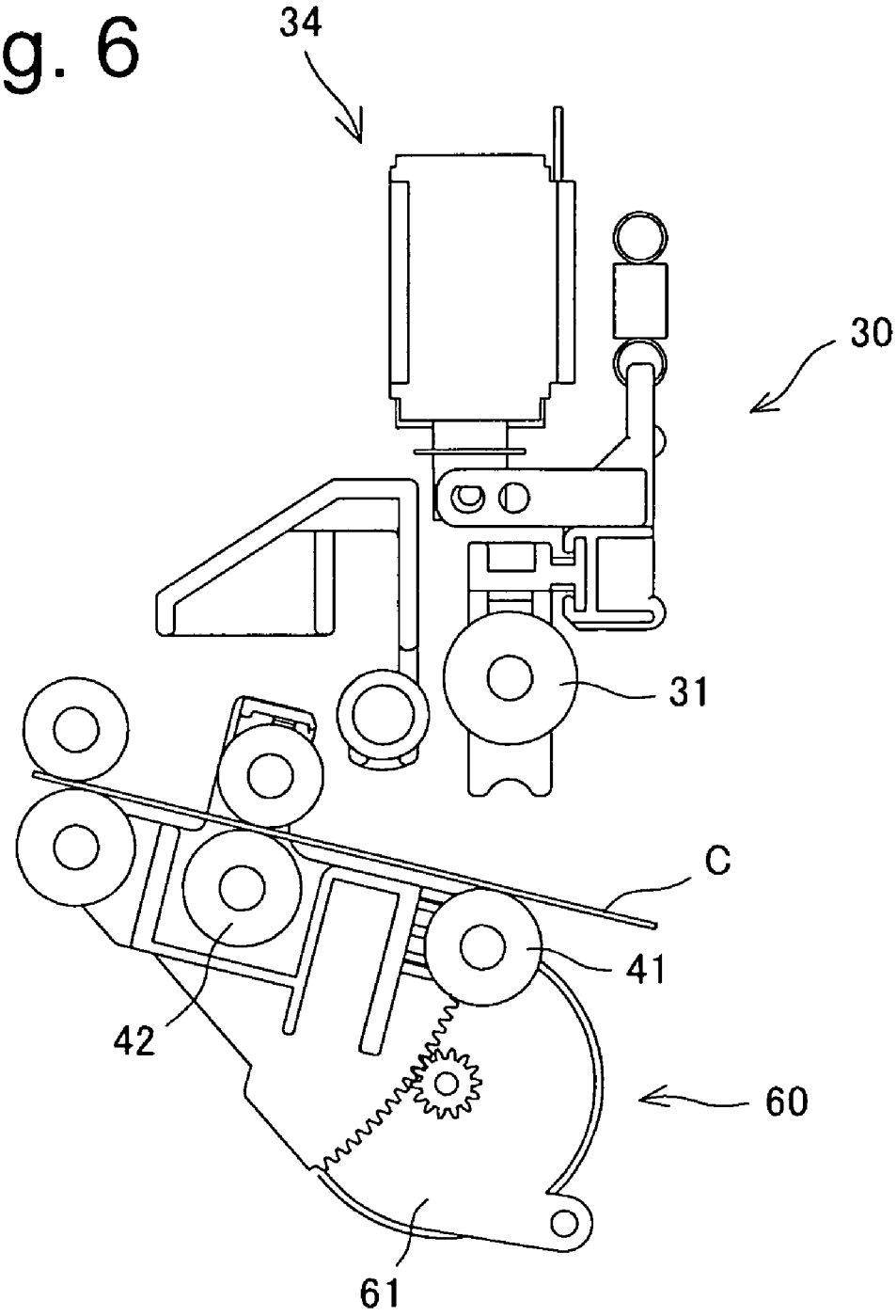
FIG. 6 is a partly enlarged view illustrating the operation of the conveying roller moving mechanism and the card cleaning mechanism, wherein the card already subjected to the recording process is discharged.

Thus, the card C is placed in the card accommodating section 20 via the card discharge port 23 or (if the card accommodating section 20 is full of cards) discharged to the exterior through the card discharge port 21. During discharging of the card shown in FIG. 6, a cleaning roller 31 is placed at a retract position that is a home position located away from the card conveying path P1.

When the card C is placed in the card accommodating section 20 or discharged through the card discharge port 21, the CPU stops the reverse driving of the conveyance driving motor 70 and the motor (not shown in the drawings). At a predetermined timing when the operation of discharging the card C to the card accommodating section 20 is completed, the CPU drives the stepping motor 61 again (rotational driving in the reverse direction) to return the conveying rollers 41 and 42 from the second position where the conveying rollers 41 and 42 are positioned so as to form the inclined card conveying path to the first position where the conveying rollers 41 and 42 are positioned so as to form the substantially horizontal card conveying path. Thus, the process of printing the card C is completed. If another job needs to be carried out, the above-described operation is repeated.

Now, the effects of the printer apparatus 1 according to the present embodiment will be described.

As described above, in the present embodiment, the registration of the ink ribbon R is controlled by comparing the distance (a) over which the ink ribbon R is taken up to eliminate the slack in the ink ribbon R after printing, with the distance (b) from the print end position to the print start position for the next color on the ink ribbon R. Thus, the slack ink ribbon R is prevented from twining around the platen roller. This allows the ribbon registration to be immediately performed, enabling a reduction in the time required for the ribbon registration. Even if the slack elimination causes the ink ribbon R to be excessively taken up, the ink ribbon R is fed back according to the distances (a) and (b), allowing the ribbon to be registered to the appropriate position for the card C.

Second Embodiment

Figure 18:
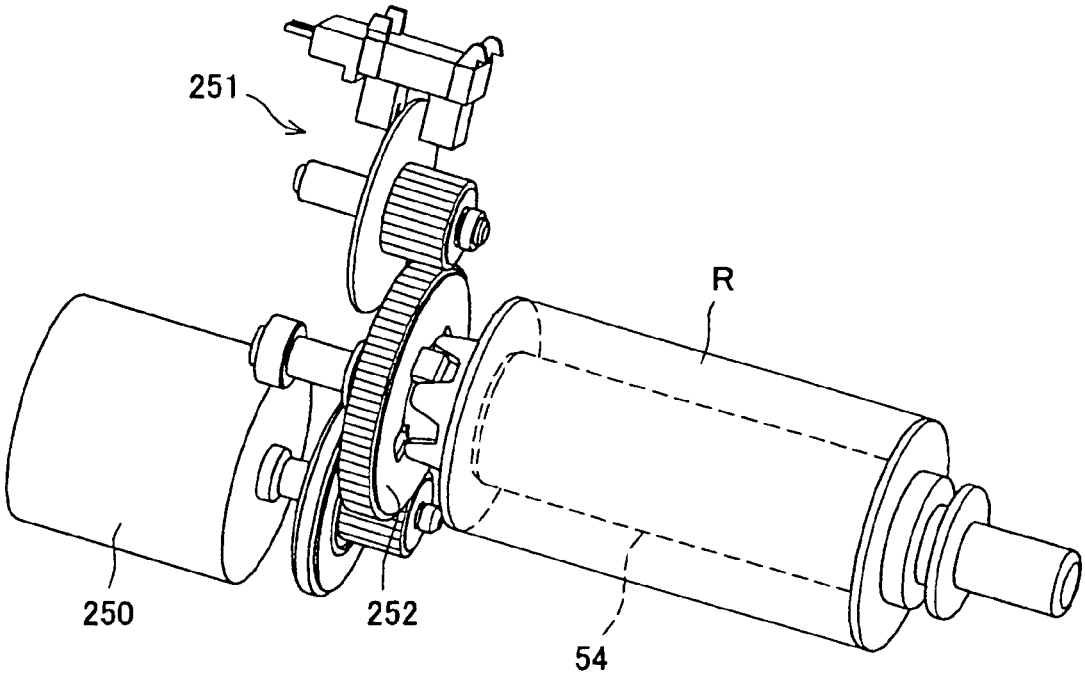
FIG. 18 is a perspective view of an appearance of an engaging section of a printer apparatus which engages a reel main body on a supply reel side according to a second embodiment.

In the above-described embodiment, the takeup reel 55 side takes up the ink ribbon R to eliminate the slack in the ink ribbon R. However, the supply reel 54 may takes up the ink ribbon R to eliminate the slack in the ink ribbon R. In this case, the slack in the ink ribbon R can be eliminated by providing a supply reel driving motor 250 that drives the supply reel 54 (FIG. 18).

The flow of the printing process will be described below. The expression "take up the ink ribbon R" hereinafter refers to an operation in which the supply reel driving motor 250 is reversely driven to rotate the ribbon supply reel 54 in a direction in which the slack in the ink ribbon R is eliminated. The expression "feed back the ink ribbon R" hereinafter refers to an operation in which the supply reel driving motor 250 is driven forward to rotate the ribbon supply reel 54 in a direction in which the ink ribbon R goes slack.

When a print request is received from the higher-order apparatus 100, first, the card C is fed through the card supply port 14. Thereafter, the ink ribbon R is fed back by 3 mm (the ink ribbon R goes slack).

Then, the slack in the ink ribbon R is eliminated. First, the distance (b) from the current ribbon position (for the first printing, the position where the trailing end of the ink layer Bk is detected by the transmission sensor made up of the light emitting element 58 and the light receiving element 59) to the ribbon position where printing is started (in the present embodiment, the position where printing of the Y color is started because the Y color is first printed) is calculated. The distance (b) is stored in the RAM. Thereafter, the slack in the ink ribbon R is eliminated. The distance (a) (in the present embodiment, 3 mm) over which the ink ribbon R has moved to eliminate the slack in the ink ribbon R is stored in the RAM.

In this condition, the ink ribbon R is not slack. Thus, the card C is conveyed for registration. Thereafter, the takeup reel driving motor 150 is driven by a distance equal to the sum of the distances (a) and (b) stored in the RAM, to rotate the ribbon takeup reel 55 to take up the ink ribbon R. The ribbon registration for the Y color is also performed. The thermal head 51 is then lowered to the print position, and printing of the Y color is started (FIG. 8).

Figure 19:
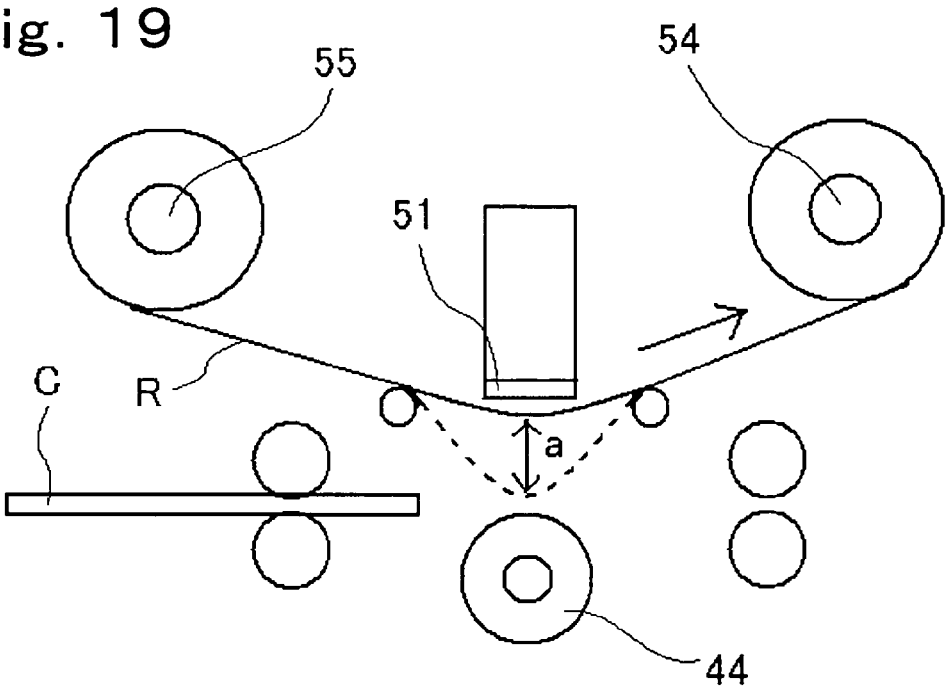
FIG. 19 is a diagram illustrating a printing operation according to a second embodiment and showing that a slack has been eliminated.

When printing of the Y color is completed, the thermal head 51 is elevated to the retract position. At this time, the ink ribbon R becomes slack by the distance (in the present embodiment, 4 mm) over which the thermal head 51 has moved (FIG. 12). Thus, if the M (Magenta) color is to be printed next, the ribbon registration is performed. Then, as described above, the distance (b) from the current position of the ink ribbon R (Y print end position) to the M print start position is calculated. Thereafter, the slack in the ink ribbon R is eliminated (FIG. 19). The distance (a) (in the present embodiment, 3 mm) over which the ink ribbon R has moved to eliminate the slack in the ink ribbon R is stored in the RAM.

Figure 20:
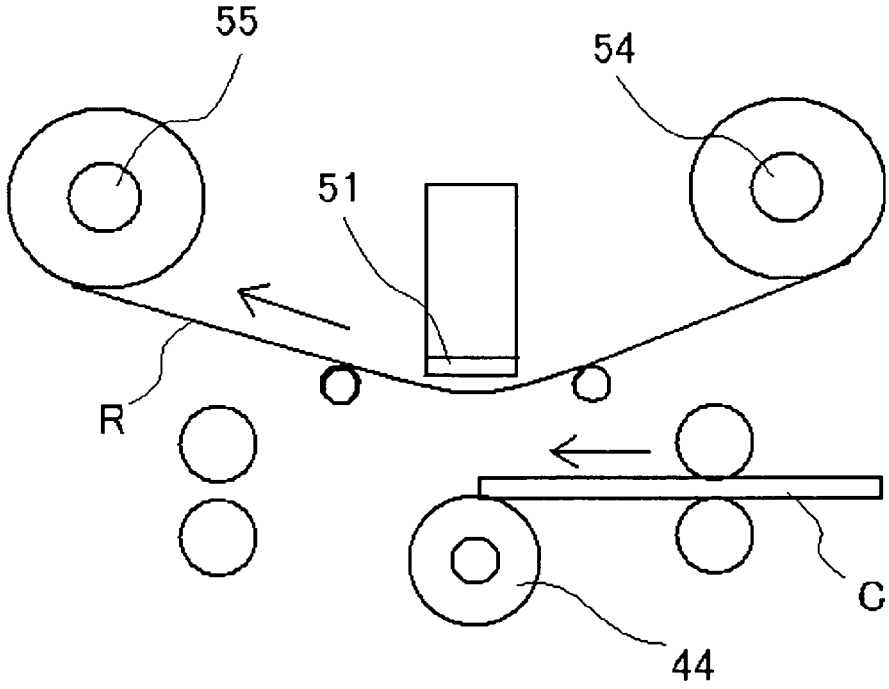
FIG. 20 is a diagram illustrating the printing operation according to the second embodiment and showing that a ribbon is being registered.
Figure 21:
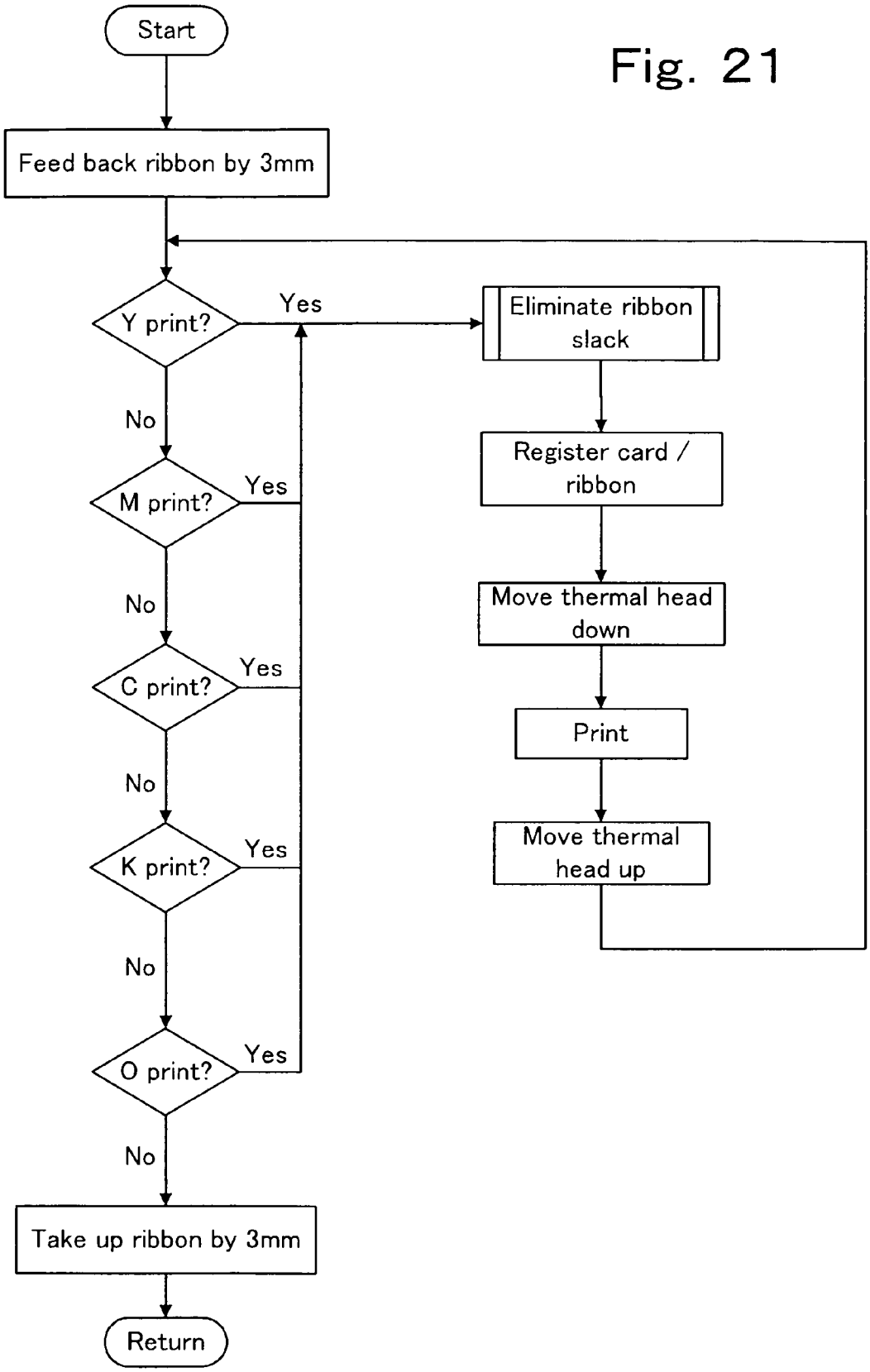
FIG. 21 is a flowchart illustrating a flow of the printing operation according to the second embodiment.
Figure 22:
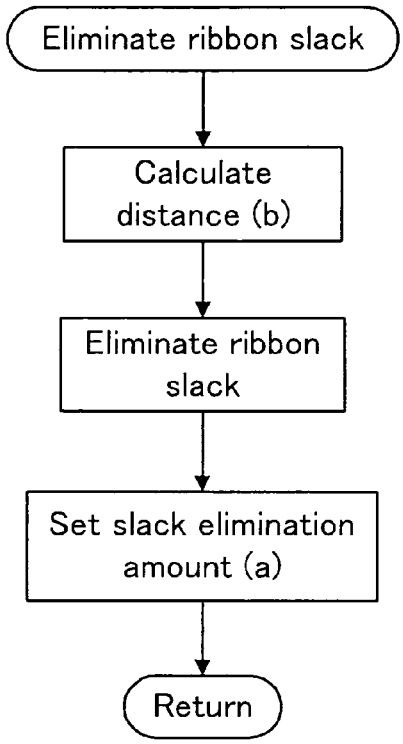
FIG. 22 is a flowchart illustrating a slack eliminating step in FIG. 21.

In this condition, the ink ribbon R is not slack. Thus, the card C is conveyed for registration (FIG. 20). At the same time, the takeup reel driving motor is driven by an amount corresponding to the sum of the distances (a) and (b) stored in the RAM, to rotate the ribbon takeup reel 55 to take up the ink ribbon R. The ribbon registration for the next color (M color) is also performed (FIG. 20). The thermal head 51 is lowered to the print position, and printing of the M color is started (FIG. 11). To subsequently print the C (Cyan) color, the Bk (Black) color, and the Op (protect layer), operations similar to those of the process of printing the M (Magenta) color are performed.

Finally, the Op (protect layer) is printed. Then, to allow the card C to be discharged, the ink ribbon R is taken up by 3 mm to eliminate the slack in the ink ribbon R to complete the printing process.

All of the Y, M, C, Bk, and Op are not printed. Thus, when the ink ribbon R is registered, a color not to be printed is skipped and the ink ribbon R is set for the next color. Furthermore, when printing of one card C is completed, the ink ribbon R is taken up by 3 mm, and the card C is discharged to complete the printing process. Additionally, in the present embodiment, when the ink ribbon R becomes slack by 4 mm, the ink ribbon R is taken up by 3 mm in order to eliminate the slack in the ink ribbon R. However, if the supply reel driving motor 250 eliminates the slack, the ink ribbon R may be taken up by any distance. However, the distance (a) over which the ink ribbon R has been taken up needs to be stored in the RAM. Thus, a color image (including the protect layer) of the Y, M, C, Bk, and Op is formed on the surface of the card C.

The disclosure of Japanese Patent Application No. 2007-285848 filed on Nov. 2, 2007 is incorporated herein as a reference.

What is claimed is:

1. A printing apparatus for compressing a thermal head against a medium via an ink ribbon to print an image on the medium, the apparatus comprising:

a ribbon supply reel for winding an unused portion of an ink ribbon;

a ribbon takeup reel for winding a used portion of the ink ribbon;

a thermal head moving device for moving the thermal head between a print position and a retract position separated from the print position;

a takeup reel driving device for driving the ribbon takeup reel;

a ribbon position detecting device for detecting a position of the ink ribbon;

a medium registering device for registering the medium to the print position; and a control device for controlling driving of the takeup reel driving device, the control device aligning a predetermined area of the ink ribbon with a print start position according to a first distance over which the ink ribbon moves as a result of the takeup reel driving device driving the takeup reel in a direction in which a slack in the ink ribbon is eliminated, when printing is completed with the thermal head moving to the retract position, and a second distance between a print end position obtained by the ribbon position detecting device and a next print start position.

2. The printing apparatus according to claim 1, wherein the control device controls such that when the first distance is longer than the second distance, the takeup reel driving device is driven to eliminate the slack in the ink ribbon, and after the medium registering device registers the medium to the print position, the takeup reel driving device feeds back the ink ribbon by a length corresponding to a difference between the first distance and the second distance.

3. The printing apparatus according to claim 1, wherein the control device controls such that when the second distance is longer than the first distance, the takeup reel driving device takes up the ink ribbon by a length corresponding to the second distance.

4. The printing apparatus according to claim 1, wherein the first distance is shorter than a distance over which the thermal head moves from the print position to a standby position.

5. The printing apparatus according to claim 1, wherein the ribbon position detecting device comprises a transmission sensor and an encoder sensor detecting rotation of the supply reel.

6. A printing apparatus for compressing a thermal head against a medium via an ink ribbon to print an image on the medium, the apparatus comprising:

a ribbon supply reel for winding an unused portion of an ink ribbon;

a ribbon takeup reel for winding a used portion of the ink ribbon;

a thermal head moving device for moving the thermal head between a print position and a retract position separated from the print position;

a takeup reel driving device for driving the ribbon takeup reel;

a supply reel driving device for driving the ribbon supply reel;

a ribbon position detecting device for detecting a position of the ink ribbon;

a medium registering device for registering the medium to the print position; and a control device for controlling the supply reel driving motor and the takeup reel driving device, said control device controlling the takeup reel driving device to align a predetermined area of the ink ribbon with a print start position, according to a first distance over which the ink ribbon moves as a result of the supply reel driving device driving the supply reel in a direction in which a slack in the ink ribbon is eliminated to take up the ink ribbon, when printing is completed with the thermal head moved to the retract position, and a second distance between a print end position obtained by the ribbon position detecting device and a next print start position.

7. The printing apparatus according to claim 6, wherein the control device controls such that the takeup reel driving device takes up the ink ribbon by a length obtained by adding the first distance and the second distance together.

8. The printing apparatus according to claim 6, wherein the ribbon position detecting device comprises a transmission sensor and an encoder sensor detecting rotation of the supply reel.

9. A printing method for compressing a thermal head against a medium via an ink ribbon to print an image on the medium, the method comprising the steps of:

a thermal head moving step of moving the thermal head between a print position and a retract position separated from the print position;

a ribbon position detecting step of detecting a position of the ink ribbon;

a slack eliminating step of eliminating a slack in the ink ribbon when printing is completed to move the thermal head to the retract position;

a medium registering step of registering a medium to the print position; and a ribbon registering step of registering the ink ribbon according to a first distance over which the ink ribbon moves during the slack eliminating step and a second distance between a print end position obtained during the ribbon position detecting step and a next print start position.

10. The printing method according to claim 9, wherein if the first distance is longer than the second distance, in the slack eliminating step, the ink ribbon is taken up by a length corresponding to the first distance; in the medium registering step, the medium is registered to the medium print position; and then in the ribbon registering step, the ink ribbon is fed back by a length corresponding to a difference between the first distance and the second distance.

11. The printing method according to claim 9, wherein if the second distance is longer than the first distance, in the ribbon registering step, the ink ribbon is taken up by a length corresponding to the second distance.

12. The printing method according to claim 9, wherein after a slack in the ink ribbon is eliminated in the slack eliminating step, in the ribbon registering step, simultaneously with the registration of the medium to the print position in the medium registering step, the ink ribbon is taken up, by a length corresponding to a sum of the first distance and the second distance, in a direction opposite to a direction in which the ink ribbon is taken up to eliminate the slack in the ink ribbon during the slack eliminating step.

* * * * *